US010436195B2

(12) United States Patent
Sandore et al.

(10) Patent No.: US 10,436,195 B2
(45) Date of Patent: Oct. 8, 2019

(54) MAGNETICALLY ENGAGED PUMP

(71) Applicant: WILDEN PUMP AND ENGINEERING LLC, Grand Terrace, CA (US)

(72) Inventors: Brian James Sandore, Corona, CA (US); Loren Michael Libby, Nashua, NH (US); Nicholas William Ortega, Riverside, CA (US); Robert George Schwartz, Riverside, CA (US); Christopher Leopold, Chino, CA (US); Clark Shafer, Bolingbrook, IL (US); William Blankemeier, Oak Park, IL (US)

(73) Assignee: WILDEN PUMP AND ENGINEERING LLC, Grand Terrace, CA (US)

( * ) Notice: Subject to any disclaimer, the term of this patent is extended or adjusted under 35 U.S.C. 154(b) by 0 days.

(21) Appl. No.: 16/138,255

(22) Filed: Sep. 21, 2018

(65) Prior Publication Data

US 2019/0024660 A1 Jan. 24, 2019

Related U.S. Application Data

(63) Continuation of application No. 15/498,241, filed on Apr. 26, 2017, now Pat. No. 10,240,600.

(51) Int. Cl.
*F04D 13/02* (2006.01)
*F04D 29/60* (2006.01)
(Continued)

(52) U.S. Cl.
CPC ..... *F04C 15/0069* (2013.01); *F01C 1/063* (2013.01); *F01C 1/10* (2013.01);
(Continued)

(58) Field of Classification Search
CPC .... F04D 29/605; F04D 29/606; F04D 29/607; F04D 29/62; F04D 29/628; F04D 29/046;
(Continued)

(56) References Cited

U.S. PATENT DOCUMENTS 1,427,391 A * 8/1922 Johns ..... F03B 1/00 416/183
2,956,841 A 10/1960 Cametti et al.
(Continued)

FOREIGN PATENT DOCUMENTS

TW M527045 8/2016

OTHER PUBLICATIONS

Machine Translation of relevant portions of Abstract and Detailed Description of TWM527045, Aug. 11, 2016—Flow Engineering Corp.

(Continued)

*Primary Examiner* — Philip E Stimpert
(74) *Attorney, Agent, or Firm* — Karish & Bjorgum, PC

(57) ABSTRACT

A magnetically engaged pump includes a pump housing with a rotatable magnetic drive assembly, a cylindrical canister and a rotatable driven magnet assembly. This magnetic coupling is associated with a pump rotor and a laterally positioned gear wheel to define a gear pump. This magnetic coupling is alternatively associated with a pump rotor with an impeller to define a centrifugal pump. Either pump includes a stationary shaft to mount the driven magnet assembly and pump rotor. A rotatable carrier with bushings and thrust bushings coaxially supports the rotatable driven magnet assembly and pump rotor.

10 Claims, 6 Drawing Sheets

(51) Int. Cl.

| | |
|---|---|
| ***F04C 15/00*** | (2006.01) |
| ***F04C 2/10*** | (2006.01) |
| ***F01C 1/063*** | (2006.01) |
| ***F01C 1/24*** | (2006.01) |
| ***F01C 1/10*** | (2006.01) |
| ***F01C 1/18*** | (2006.01) |
| *F04D 29/22* | (2006.01) |

(52) U.S. Cl.
CPC ..... *F01C 1/18* (2013.01); *F01C 1/24* (2013.01); *F04C 2/10* (2013.01); *F04C 2/101* (2013.01); *F04D 13/024* (2013.01); *F04D 13/026* (2013.01); *F04D 29/605* (2013.01); *F04C 2230/70* (2013.01); *F04C 2240/60* (2013.01); *F04D 29/2222* (2013.01)

(58) Field of Classification Search
CPC ..... F04D 29/0462; F01C 1/063; F01C 1/10; F01C 1/18; F01C 1/24; F01C 2/101
USPC ..... 416/120, 121, 124–126
See application file for complete search history.

(56) References Cited

U.S. PATENT DOCUMENTS

| | | | | |
|---|---|---|---|---|
| 3,398,695 | A | | 8/1968 | Pritz |
| 3,877,844 | A | | 4/1975 | Klaus et al. |
| 4,013,384 | A | * | 3/1977 | Oikawa ..... F04D 3/02 415/10 |
| 4,080,112 | A | | 3/1978 | Zimmerman |
| 4,487,557 | A | | 12/1984 | Ruyak et al. |
| 4,661,044 | A | | 4/1987 | Freeland |
| 4,722,661 | A | | 2/1988 | Mizuno |
| 4,871,301 | A | | 10/1989 | Buse |
| 5,385,445 | A | | 1/1995 | McKenna |
| 5,392,503 | A | | 2/1995 | Stavale |
| 5,547,289 | A | | 8/1996 | Urban |
| 5,779,449 | A | | 7/1998 | Klein |
| 5,831,364 | A | | 11/1998 | Buse |
| 7,137,793 | B2 | | 11/2006 | Shafer et al. |
| 7,183,683 | B2 | | 2/2007 | Shafer et al. |
| 7,549,205 | B2 | | 6/2009 | Shafer |
| 2012/0177511 | A1 | | 7/2012 | Sexton et al. |
| 2015/0260191 | A1 | | 9/2015 | Blankemeier et al. |
| 2016/0084256 | A1 | | 3/2016 | Drechsel et al. |

OTHER PUBLICATIONS

English translation of Bibliographic Data of TWM527045, Aug. 11, 2016—Flow Engineering Corp.
International Search Report & Written Opinion, dated Jun. 29, 2018, re PCT/US18/27076, 11 pgs.

* cited by examiner

MAGNETICALLY ENGAGED PUMP

RELATED APPLICATION

This is a continuation of U.S. patent application Ser. No. 15/498,241, filed Apr. 26, 2017, the disclosure of which is incorporated herein by reference.

BACKGROUND OF THE INVENTION

The field of the present invention is pumps which are magnetically coupled to a power source.

U.S. Pat. No. 7,137,793 to Shafer et al., U.S. Pat. No. 7,183,683 to Shafer et al. and U.S. Pat. No. 7,549,205 to Shafer are directed to magnetically engaged pumps, the disclosures of which are incorporated herein by reference.

SUMMARY OF THE INVENTION

The present invention is directed to pumps having a pump housing. A shaft is fixed within the pump housing. A pump rotor is rotatably mounted about the fixed shaft. A magnetic engagement, including a magnetic drive assembly, a magnetic driven assembly associated with the pump rotor and a canister between the drive assembly and the driven assembly provides a sealless engagement between the drive assembly and the pump rotor. The pump further includes a rotatable carrier about the stationary shaft. This carrier includes a radial attachment flange fixable to the driven magnetic assembly. The rotatable carrier is axially removable through the pump rotor. The carrier includes a plain bearing position to receive a bushing. The arrangement of the rotatable carrier thus allows replacement of the bearing support without requiring the pump to be taken out of its mounting or the magnetic coupling assembly to be disrupted. The carrier may also include thrust bushing positions which can face a shoulder on the fixed shaft and face the end of the canister.

In the preferred embodiments, multiple categories of pumps are disclosed. Further, selective integrations of components are disclosed in the embodiments. It is intended and here taught that the independent variations in each embodiment may be employed in the other embodiment with equal applicability.

Reference numbers in the Figures correspond between embodiments where the elements illustrated are the same.

DETAILED DESCRIPTION OF THE PREFERRED EMBODIMENT

Figure 1:
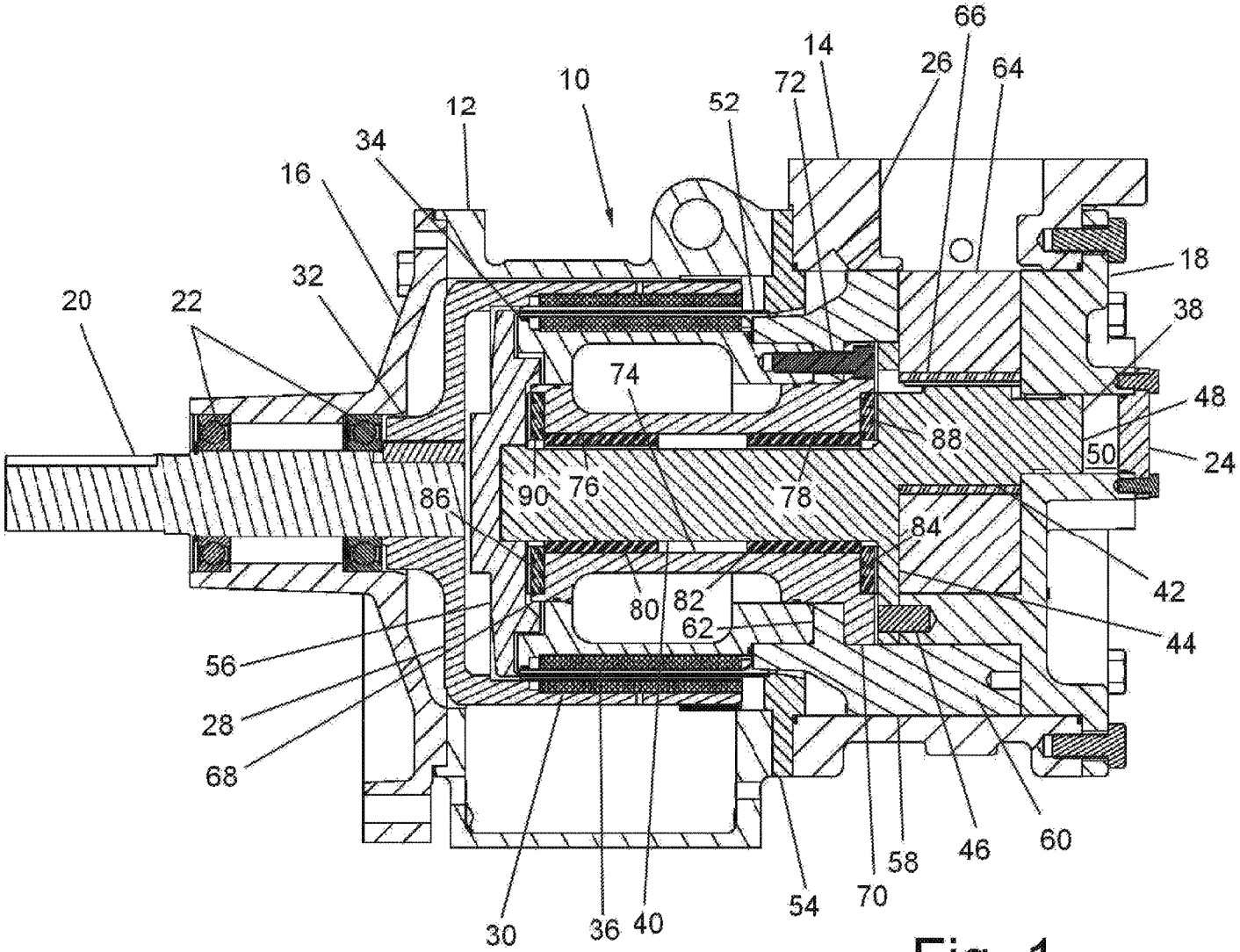
FIG. 1 is a side view of a magnetically engaged gear pump shown in cross section through the principal axis of the pump.
Figure 2:
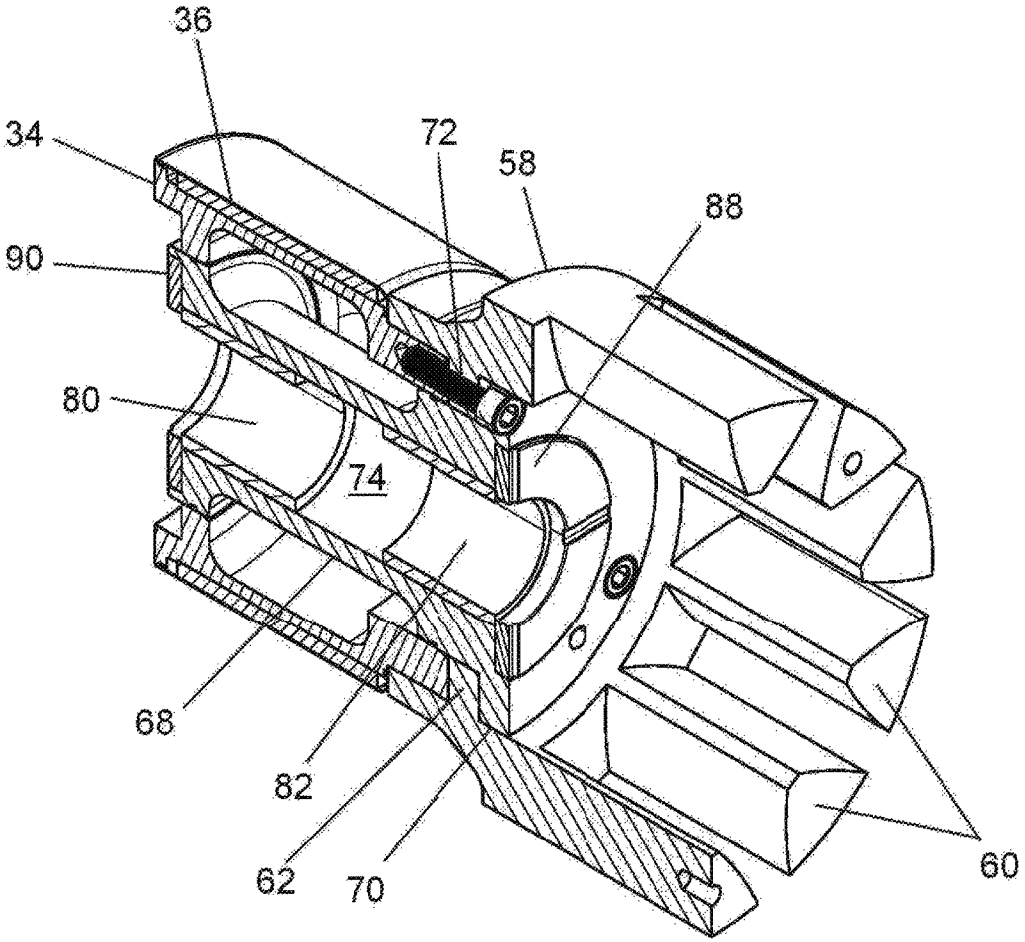
FIG. 2 is an isometric view also in cross section through the principal axis of the magnetically engaged gear pump illustrating the pump rotor, the rotatable driven magnetic assembly and the rotatable carrier assembly.
Figure 3:
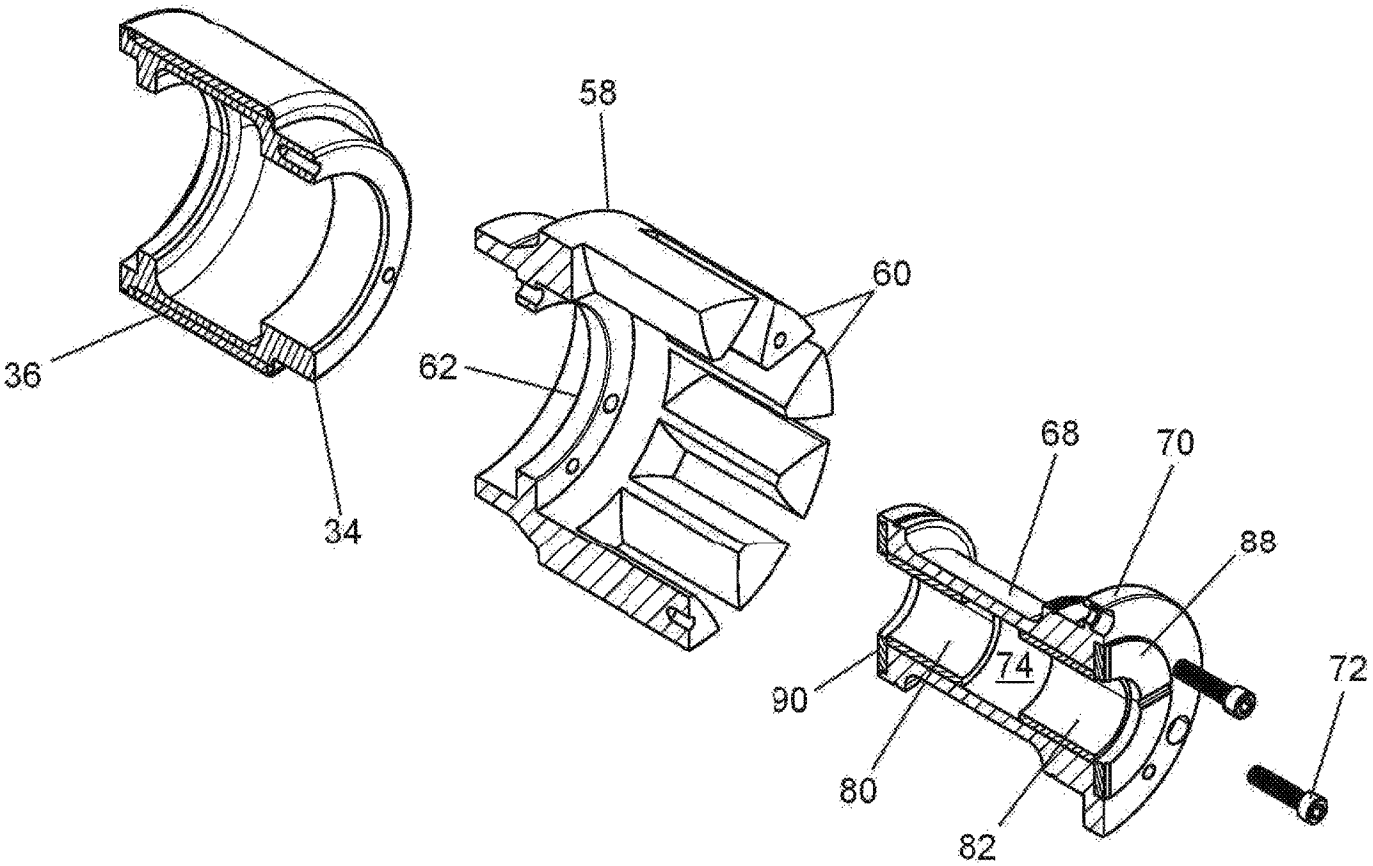
FIG. 3 is an isometric cross section taken through the principal axis of the pump of the three assemblies of FIG. 2 in exploded assembly.

Turning in detail to the Figures, a gear pump with a magnetic engagement is disclosed in the preferred embodiment of FIGS. 1 through 3. The gear pump includes a pump housing, generally designated 10, defined by a first housing portion 12 and a second housing portion 14. The portions are bolted together. The pump housing 10 further includes a bearing cap 16 closing a first end of the pump housing 10 by being bolted to the first housing portion 12 and a pump shaft support 18 closing a second end of the pump housing 10 and bolted to the second housing portion 14. The bearing cap 16 includes a power coupling through a drive shaft 20 mounted in bearings 22. The drive shaft 20 is capable of being keyed to a rotational source of power (not shown). The pump shaft support 18 includes a cap 24. The fluid inlet (not shown) and a fluid outlet 26 conventionally extend into the pump housing 10.

A rotatable magnetic drive assembly includes a cup-shaped drive member 28. Magnets 30 are held in an annular arrangement about the axial recess defined by the cup-shaped member 28. A hub 32 on the member 28 is mounted to the drive shaft 20 and keyed to rotate therewith. The cup-shaped portion is cantilevered from the hub 32 within the pump housing 10 forming a cylindrical surround for the magnetic coupling.

A rotatable driven magnetic assembly includes a generally cylindrical magnet mount 34 with magnets 36 about the periphery to define a magnetic portion physically disposed substantially in alignment with the magnets 30 for magnetic alignment to enable a magnetic coupling. With the rotatable magnetic drive assembly and the rotatable driven magnetic assembly, the magnetic coupling is conventionally arranged.

A complex stationary mounting shaft 38 fixed to the pump housing at the pump shaft support 18 defines two cylindrical shafts 40, 42 with axes axially and laterally displaced. A radial mounting flange 44 is located between the two shafts 40, 42. The mounting shaft 38 is mounted to the shaft support 18 by fasteners 46 to the mounting flange 44 and by a stub end 48 on the cylindrical shaft 42 positioned within a cavity 50 in the shaft support 18. This arrangement structurally cantilevers the shaft 40 into the magnetic coupling. The mounting flange 44 further defines a shoulder at one end of the cylindrical shaft 40 facing the drive end of the gear pump.

To divide the sealless magnetic coupling defined by the magnets 30, 36, a cylindrical canister extends between the magnets 30, 36 within the axial recess of the cup-shaped drive member 28. The canister is thin walled between the magnets 30, 36 and is of non-ferromagnetic material to avoid interference with the magnetic coupling. The canister 52 is fixed to the pump housing 10 by a radial mounting flange 54 to effect a sealing engagement.

The mounting flange 54 is conveniently fixed between the first and second housing portions 12, 14. At the other end of the canister 52, a canister cap 56 closes the canister 52. The canister cap 56 receives the end of the cylindrical shaft 40, which helps to position the thin wall of the canister 52. The canister cap 56 also defines a shoulder facing the pump shaft support second end of the pump housing 10. A center knob on the canister cap 56 extends to near the pump housing. This will prevent the canister cap 56 from excessive deflection if the defined shoulder is pushed too far.

A pump rotor 58 is fixable to the magnet mount 34 of the rotatable driven magnet assembly in the gear pump. The pump rotor 58 is principally positioned within the first housing portion 12 of the pump housing 10 and includes an annular gear with teeth 60 as best seen in FIGS. 2 and 3. An inwardly extending radial mounting flange 62 on the pump rotor 58 abuts against the near end of the magnet mount 34 of the rotatable driven magnet assembly. A gear wheel 64 is rotatably mounted about the laterally displaced cylindrical shaft 42 about a bushing 66. The rotatable gear wheel 64 is meshed with the teeth 60 of the annular gear of the pump rotor 58. This gear then defines a gear pump in communication with the fluid inlet and fluid outlet 26 of the pump.

A rotatable carrier 68 is mounted about the cylindrical shaft 40. The magnet mount 34 includes a concentric cylindrical cavity extending fully therethrough to receive the rotatable carrier 68. The magnet mount 34 and the rotatable carrier 68 are shown to define an annular cavity therebetween to reduce material and weight. O-rings may be placed at the contact surfaces between the two components, as seen in FIG. 3, to isolate the annular cavity from working fluids.

A radial attachment flange 70 is located at the end of the rotatable carrier 68 adjacent the pump rotor 58. This radial attachment flange 70 is outwardly of the inwardly extending mounting flange 62 of the pump rotor 58. Three fasteners 72 equiangularly spaced extend through mounting holes in the radial attachment flange 70, the inwardly extending radial mounting flange 62 and the end of the magnet mount 34 to retain these three elements together such that they are able to rotate as an assembly about the cylindrical shaft 40.

The rotatable carrier 68 includes a bore 74 therethrough to receive the shaft 40. In the gear pump, the bore 74 includes two plain bearing positions 76, 78 to retain bushings 80, 82 for concentrically mounting the magnet mount 34 and the pump rotor 58 about the shaft 40. The ends of the rotatable carrier 68 about the bore 74 include thrust bearing positions 84, 86 to retain thrust bushings 88, 90 to face the shoulder on the mounting flange 44 of the shaft 40 and the canister cap 56, respectively.

The rotatable carrier 68 has the attribute of providing a mechanism for the positive retention and arrangement of the bushings 80, 82, 88, 90. Further, the entire rotatable subassembly, as illustrated in FIGS. 2 and 3, can be accessed without removing the pump from its mounting and plumbing. By removal of the pump shaft support 18, the mounting shaft 38 can be withdrawn with the gear wheel 64. This exposes the fasteners 72. Optionally, the entire assembly as illustrated in FIGS. 2 and 3 can be withdrawn with the fasteners 72 in place. More importantly, the fasteners 72 can be removed, allowing the rotatable carrier 68 to be withdrawn while leaving the remainder of the pump including the rotor 58 and the magnet mount 34 in place. All bushings in the pump and the rotatable carrier 68 can be inspected and replaced. The principal bushings of the close tolerance magnetic coupling can be received as a unit and installed as such.

Figure 4:
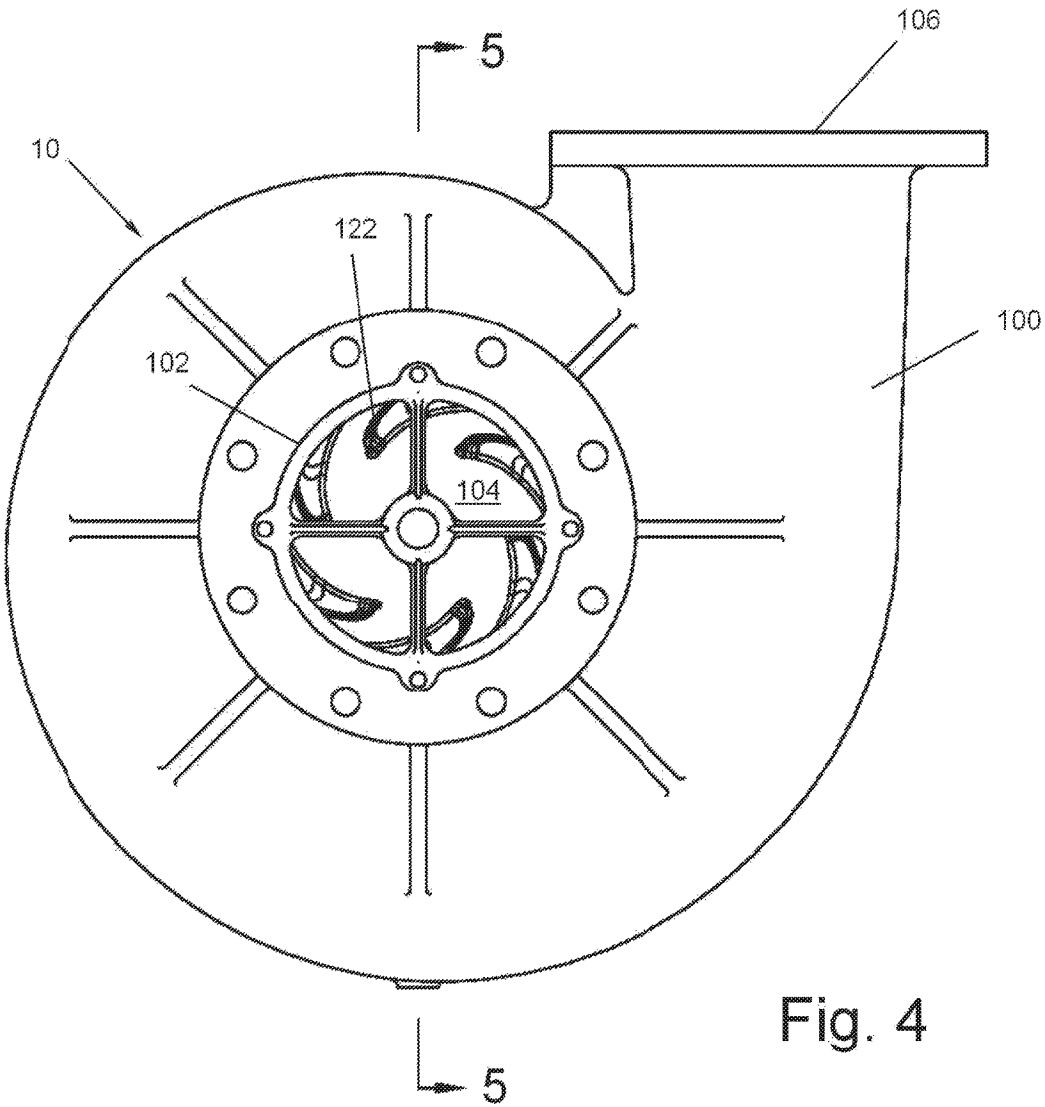
FIG. 4 a front view of a magnetically engaged centrifugal pump.
Figure 5:
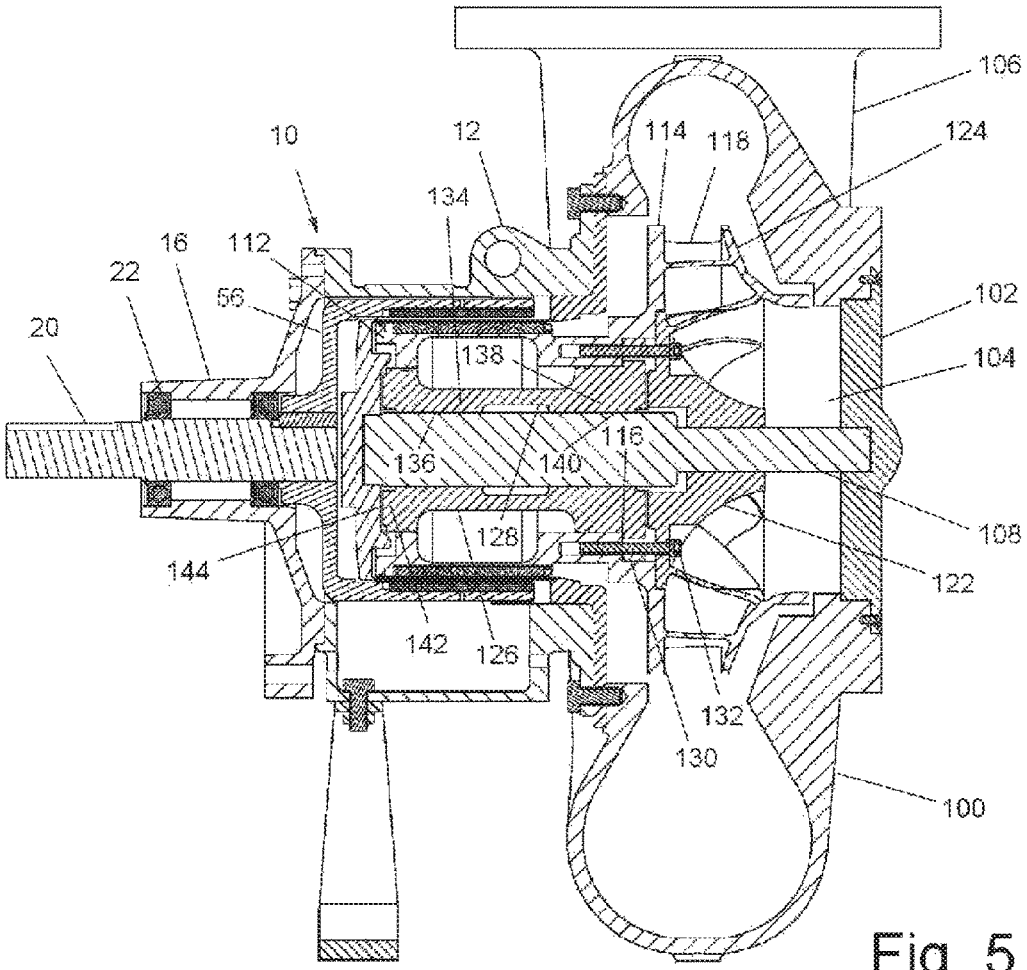
FIG. 5 is a side view of the magnetically engaged centrifugal pump shown in cross section through the principal axis of the pump.
Figure 6:
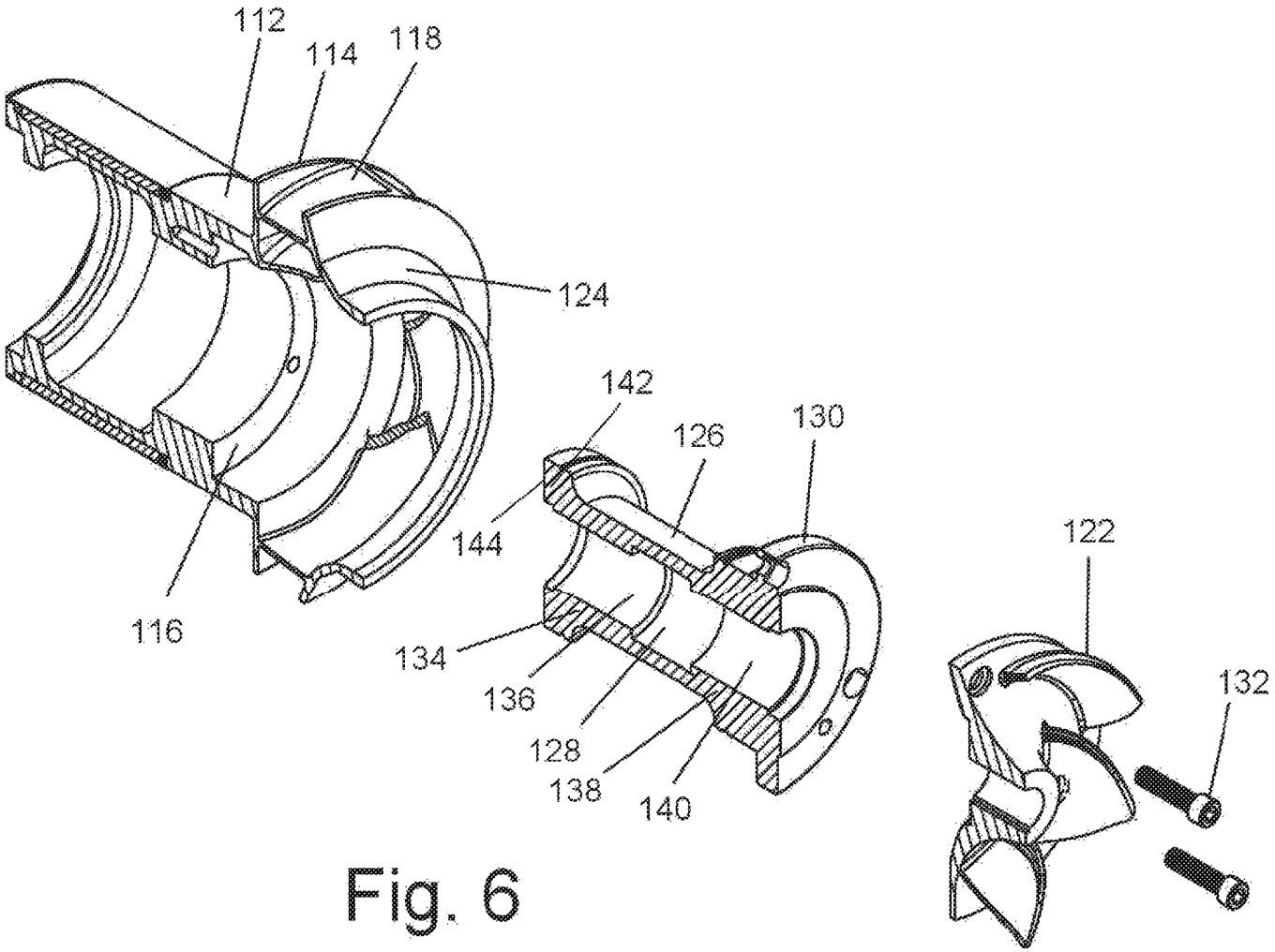
FIG. 6 is an isometric cross section taken through the principal axis of the magnetically engaged centrifugal pump of the pump rotor, the rotatable driven magnetic assembly and the rotatable carrier assembly of FIG. 5 in exploded assembly.

A centrifugal pump with a magnetic engagement is disclosed in the preferred embodiment of FIGS. 4 through 6. The pump includes a pump housing, generally designated 10, defined by a first housing portion 12 and a second housing portion 100 varying from the housing portion 14 of the gear pump in conventional ways to accommodate a centrifugal pump mechanism and flow. The portions 12 and 100 are bolted together. The pump housing 10 further includes a bearing cap 16 closing a first end of the pump housing 10 by being bolted to the first housing portion 12 and a pump shaft support 102 at a second end of the pump housing 10 and bolted to the second housing portion 100. The first end of the housing 10 remains as in the gear pump with the bearing cap 16, the drive shaft 20 and the bearings 22. The pump shaft support 102 includes a fluid inlet 104 to the pump. A fluid outlet 106 conventionally extend from the pump housing 10. A stationary mounting shaft 108 is fixed to the pump housing at the pump shaft support 102. This arrangement structurally cantilevers the shaft 108 through the pump rotor into the magnetic coupling. The stationary mounting shaft 108 also engages the canister cap 56 as in the gear pump.

The magnetic coupling in the centrifugal pump is identical to that of the gear pump. This includes the rotatable magnetic drive assembly, the rotatable driven magnetic assembly and the cylindrical canister. A magnet mount 112 of the rotatable driven magnet assembly, shown in the gear pump to be a separate cylindrical element 34, is, however, integrally formed with a pump rotor 114 in the centrifugal pump of FIGS. 4 through 6 as an extended skirt thereof. The magnet mount 112 includes an inwardly extending shoulder 116 facing the pump rotor 114. This integral configuration applies equally well to the gear pump preferred embodiment.

The pump rotor portion 114 of this integrated rotational element extending from the magnet mount 112 is principally positioned within the first housing portion 12 of the pump housing 10 and includes a shrouded annular impeller wheel 118 as best seen in FIGS. 5 and 6 to operate as a centrifugal pump. An inner impeller wheel 122 is mounted to the integrated rotational element. The inner impeller wheel 122 has a diameter which allows it to pass through the central opening in the front shroud 124 fixed to or integral with the annular impeller wheel 118. The annular impeller wheel 118 and the inner impeller wheel 122 include vanes that are aligned such that the two operate as a unit when assembled to have continuity of flow through the impeller assembly.

A rotatable carrier 126 having a central bore 128 is mounted about the stationary mounting shaft 108. The magnet mount 112 in turn includes a concentric cylindrical cavity extending fully therethrough to receive the rotatable carrier 126. The magnet mount 112 and the rotatable carrier 126 are shown to define an annular cavity therebetween to reduce material and weight. O-rings may be placed at the contact surfaces between the two components, as seen in FIG. 6, to isolate the annular cavity from working fluids.

A radial attachment flange 130 is located at the end of the rotatable carrier 126. This radial attachment flange 130 extends to mate against the inwardly extending shoulder 116. The inner impeller wheel 122 of the impeller wheel 118 mates against the other side of the radial annular flange. The radial attachment flange 130 has a diameter no larger than the diameter of the inner impeller wheel 122 of the impeller wheel 118, allowing it to pass through the impeller wheel 118 and the central opening in the front shroud 124. Three fasteners 132 equiangularly spaced extend through mounting holes in the inner impeller wheel 122, the radial attachment flange 130 and into the inwardly extending shoulder 116 to retain these three elements together. By removing the fasteners 132, the inner impeller wheel 122 of the impeller wheel 118 and the rotatable carrier 126 can be withdrawn from the pump housing 10.

The rotatable carrier 126 in the second embodiment of FIGS. 4 through 6 includes two plain bearing positions 134, 138 in the central bore 128. In this centrifugal pump, bushings 136, 140 are integrally formed with the rotatable carrier 126 at the plain bearing positions 134, 138. These bushings 136, 140 rotationally and concentrically mount the magnet mount 112 and the pump rotor 114 about the stationary mounting shaft 108. The end of the rotatable carrier 126 about the bore 128 toward the driving end of the centrifugal pump includes a thrust bearing position 142. Also in the centrifugal pump, a thrust bushing 144 is integrally formed with the rotatable carrier 126 at the thrust bearing position 142. This thrust bushing 144 faces the canister cap 56.

As true of the gear pump, the rotatable carrier 126 has the attribute of providing a mechanism for the positive retention and arrangement of the bushings 136, 140, 144. Further, the entire rotatable subassembly, as illustrated in FIGS. 5 and 6, can be accessed without disassembly of the magnetic coupling or removal of the pump rotor 114 from the pump and in turn the pump from its mounting. By removal of the pump shaft support 102, the fasteners 132 are exposed. The fasteners 132 can be removed, allowing the rotatable carrier 126 to be withdrawn while leaving the remainder of the pump including the rotor 114 and the magnet mount 112 in place.

Accordingly, an improved magnetically engaged gear pump and an improved magnetically engaged centrifugal pump are disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A magnetically engaged pump comprising a pump housing including a shaft in the housing;

a magnetic coupling in the pump housing including a rotatable magnetic drive, a rotatable driven magnet assembly inwardly of the rotatable magnetic drive and a cylindrical canister extending between the rotatable magnetic drive and the rotatable driven magnet assembly, the rotatable driven magnet assembly having a concentric cavity;

a pump rotor rotatable with the rotatable driven magnet assembly and including an axial passage;

a centrifugal inner impeller wheel rotatable with the rotatable driven magnet assembly and axially removable through the pump rotor, the pump rotor including a centrifugal annular impeller wheel having continuity of flow with the inner impeller wheel;

a carrier including a bore rotatably disposed about the shaft and at least one plain bushing in the bore bearing on the shaft, the carrier being within the concentric cavity and fitting through the axial passage for removal from the pump with the pump rotor engaged with the rotatable driven magnet assembly and the rotatable driven magnet assembly magnetically engaged with the rotatable magnetic drive.

2. The magnetically engaged pump of claim 1, the rotatable carrier being axially removable through the pump rotor from the rotatable driven magnet assembly with the inner impeller wheel and the shaft.

3. The magnetically engaged pump of claim 1, the at least one plain bushing being integral with the rotatable carrier.

4. The magnetically engaged pump of claim 1, the pump housing including a removable pump shaft support supporting the shaft.

5. The magnetically engaged pump of claim 1, the rotatable driven magnet assembly being integral with the pump rotor.

6. The magnetically engaged pump of claim 1, the at least one plain bushing being separable from the carrier.

7. The magnetically engaged pump of claim 1, the inner impeller wheel and the annular impeller wheel having vanes, wherein each of the vanes of the annular impeller wheel aligns with a respective one of the vanes of the inner impeller wheel.

8. A magnetically engaged pump comprising a pump housing including a shaft in the housing;

a magnetic coupling in the pump housing including a rotatable magnetic drive, a rotatable driven magnet assembly inwardly of the rotatable magnetic drive and a cylindrical canister extending between the rotatable magnetic drive and the rotatable driven magnet assembly, the rotatable driven magnet assembly having a concentric cavity;

a pump rotor engaged with the rotatable driven magnet assembly and including an axial passage;

a carrier including a bore rotatably disposed about the shaft, at least one plain bushing in the bore bearing on the shaft, and a radial attachment flange engageable to rotate with the rotatable driven magnet assembly, the carrier being within the concentric cavity and fitting through the axial passage for removal from the pump with the pump rotor engaged with the rotatable driven magnet assembly and the rotatable driven magnet assembly magnetically engaged with the rotatable magnetic drive;

an inner impeller wheel rotatable with the rotatable driven magnet assembly and axially removable through the pump rotor, the pump rotor including an annular impeller wheel having continuity of flow with the inner impeller wheel, the pump rotor including an inwardly extending flange, the radial attachment flange abutting against the inwardly extending flange of the pump rotor, the radial attachment flange being between the inwardly extending flange of the pump rotor and the inner impeller wheel.

9. The magnetically engaged pump of claim 8 further comprising fasteners extending, through the inner impeller wheel, the radial attachment flange and the inwardly extending flange of the pump rotor and engaging with the rotatable driven magnet assembly, in seriatim.

10. The magnetically engaged pump of claim 8, the at least one plain bushing being separable from the carrier.

* * * * *